US005080644A

United States Patent [19]

Bunch, Jr.

[11] Patent Number: 5,080,644

[45] Date of Patent: Jan. 14, 1992

[54] APPARATUS FOR REFOLDING CONTINUOUS FROM STATIONERY

[76] Inventor: Earnest B. Bunch, Jr., 9619 N. 21st Dr., Phoenix, Ariz. 85021

[21] Appl. No.: 539,561

[22] Filed: Jun. 18, 1990

[51] Int. Cl.[5] ..... B65H 45/107

[52] U.S. Cl. ..... 493/411; 493/414

[58] Field of Search ..... 493/411, 412, 413, 414, 493/415

[56] References Cited

U.S. PATENT DOCUMENTS

| | | | |
|---|---|---|---|
| 3,124,350 | 3/1964 | Huffman | 493/414 |
| 3,516,657 | 6/1970 | Knudsen | 493/411 |
| 3,912,252 | 10/1975 | Stephens | 493/414 |
| 4,056,264 | 11/1977 | Dhooge et al. | 271/178 |
| 4,380,448 | 4/1983 | Bunch | 493/413 |
| 4,427,404 | 1/1984 | Yamada | 493/414 |
| 4,447,219 | 5/1984 | Bunch | 493/413 |
| 4,547,184 | 10/1985 | Bunch | 493/414 |
| 4,650,447 | 3/1987 | Meschi | 493/357 |
| 4,820,250 | 4/1989 | Bunch | 493/414 |

FOREIGN PATENT DOCUMENTS

| | | | |
|---|---|---|---|
| 2344452 | 3/1974 | Fed. Rep. of Germany | 493/411 |

OTHER PUBLICATIONS

Lavin et al., IBM Technical Disclosure Bulletin, vol. 7, No. 4, "Forms Creasing Folding and Refolding Machine", 09/1964.

*Primary Examiner*—William E. Terrell

*Attorney, Agent, or Firm*—Tod R. Nissle

[57] ABSTRACT

Apparatus for producing continuous form stationery by refolding a strip of paper along transverse lines of weakening formed therealong. Successive lines of weakening formed in the paper are distributed in substantially opposite directions by a chute. The distributed paper is received and folded by rotating paddle wheels.

5 Claims, 4 Drawing Sheets

APPARATUS FOR REFOLDING CONTINUOUS FROM STATIONERY

This invention relates to apparatus for producing continuous form stationery by folding a strip of paper along transverse lines of weakening formed therealong.

More particularly, the invention concerns an improved stationery folding machine of the type having feed rollers which direct a continuous strip of paper into a mechanism for distributing successive lines of weakening formed in the paper in substantially opposite directions and having folding mechanisms which receive the distributed paper and crease the paper along the lines of weakening to produce continuous form stationery.

In another respect, the invention concerns an improved paper folding machine of the type described which refolds paper along transverse lines of weakening which were folded during earlier processing of the paper.

Once a strip of paper has been folded along transverse lines of weakening in the paper, refolding the paper during subsequent processing of the paper requires that less folding force be applied to the paper. Further, when the paper is being folded a second, or third time, it is important that the folding force applied to the paper be moderate, to avoid unintentional tearing of the paper. Another problem associated with refolding a previously folded strip of paper is that the lines of weakening each act like a loose hinge. Consequently, when previously folded paper passes through a chute or other mechanism for alternately distributing successive lines of weakening formed in the paper, the paper strip must be carefully controlled because the paper has a tendency to bend readily or "kink" at the previously folded lines of weakening and to jam in the chute. Since refolded paper tends to be "loose" and to more readily deviate from a desired path or shape, the need for carefully controlling the paper continues after the paper is distributed by the chute. For example, once paper has been refolded, it is normally carried by a horizontally oriented conveyor to a horizontal stacking platform or table. The stacking platform is slightly lower than the conveyor. Paper travels over the edge of the conveyor and downwardly onto the stacking table. As the amount of paper on the stacking platform increases, the platform gradually moves downwardly from the conveyor. Once the stack of paper on the platform is the desired height, the stack is removed from the stacking platform. The stacking platform is then moved upwardly to a position near the conveyor, and the process is repeated. In order to facilitate the movement of paper from the conveyor onto the stacking table, it is important that the refolded paper which is carried onto the conveyor have a certain spacing and orientation.

Accordingly, it would be highly desirable to provide an improved paper folding machine which would refold a strip of paper along lines of weakening in the paper while controlling movement of the paper through the machine both to produce folded paper having a spacing and orientation which facilitate stacking of the paper and to minimize the likelihood that the paper strip will be damaged by or jam in the folding machine.

Therefore, it is a principal object of the invention to provide an improved apparatus for producing continuous form stationery by folding a strip of paper along transverse lines of weakening formed therealong.

Another object of the invention is to produce an improved paper folding machine which refolds a strip of paper while permitting the ready production of folded paper having a desired orientation and spacing and while controlling the movement of the paper through the machine to minimize the risk that the paper will "kink" along lines of weakening while traveling through the machine.

These and other, further and more specific objects and advantages of the invention will be apparent to those skilled in the art from the following detailed description thereof, taken in conjunction with the drawings, in which.

Briefly, in accordance with my invention, I provide improved folding means for use in combination with apparatus for producing continuous form stationery by refolding a strip of paper along transverse lines of weakening formed therein. The apparatus includes a frame; oscillating guide means mounted on the frame for alternately distributing the successive lines of weakening in the paper in substantially opposite directions; and, means for feeding paper into the guide means at a predetermined speed. The improved folding means is carried on the frame and is operatively associated with the oscillating guide means to receive the lines of weakening distributed by the oscillating guide means in one of the opposite directions to urge the paper distributed by the guide means into a folded condition. The improved folding means includes a first driven axle means rotatably mounted on the frame near the lines of weakening distributed by the guide means in the one of the opposite directions, the axle means having a longitudinal axis generally parallel to the distributed lines of weakening; a plurality of spaced apart outwardly extending beater arms carried on the driven axle means, simultaneously rotating with the driven axle means, and shaped and dimensioned to contact and downwardly displace paper distributed by the oscillating guide means; second driven axle means rotatably mounted on the frame, spaced apart from the first driven axle means, and having a longitudinal axis generally parallel to the distributed lines of weakening and to the longitudinal axis of the first driven axle means; and, a plurality of spaced apart outwardly extending receiving arms. The receiving arms are carried on the second driven axle means; simultaneously rotate with the second driven axle means; receive folded lines of weakening between opposing pairs of the receiving arms; and, guide the lines of weakening received between the receiving arms away from the chute and from the first driven axle means. The first driven axle means can rotate at a speed greater than the second driven axle means.

Figure 1:
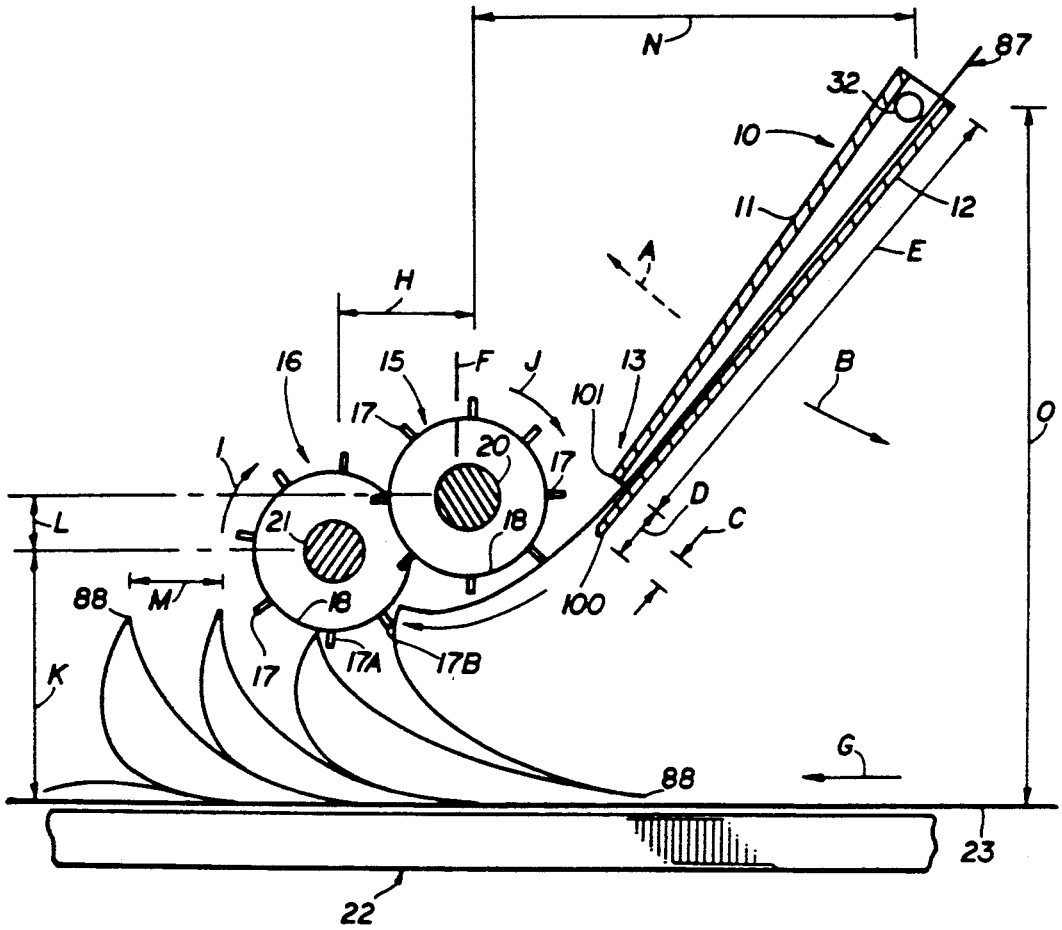
FIG. 1 is a/side section view illustrating a paper folding machine ,constructed in accordance with the principles of the invention.
Figure 2:
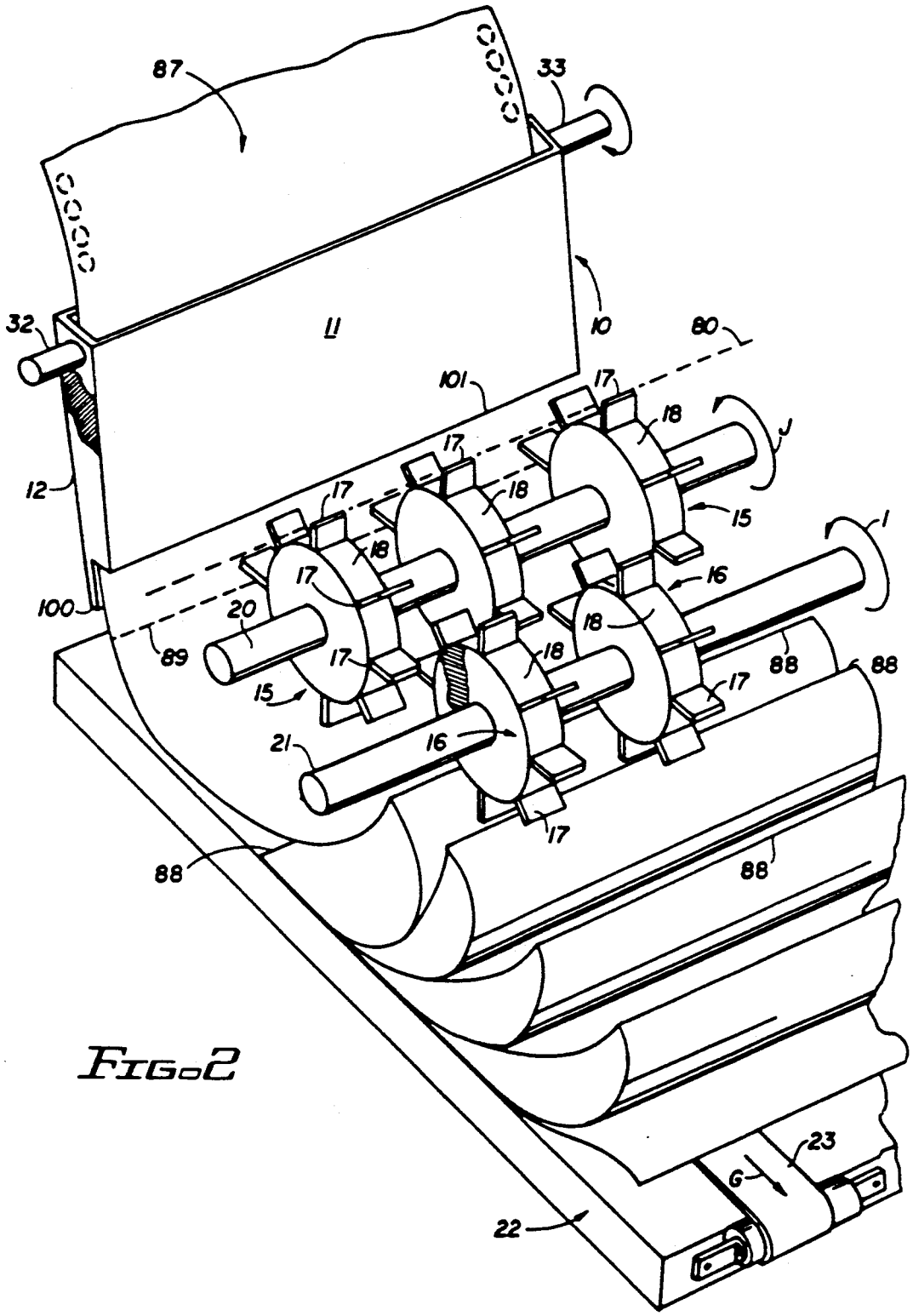
FIG. 2 is a perspective view of the paper folding machine of FIG. 1 illustrating further construction details thereof.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 and 2 illustrate a paper folding machine constructed in accordance with the principles of the invention and including an oscillating guide means or chute 10. In FIG. 1, chute 10 is illustrated in the farthest extent of its travel in the direction of arrow A and is ready to begin its swing through an arc in the opposite direction indicated by arrow B. Paper strip 87 has transverse lines of weakening or perforation 89 formed therein. Each line of weakening is normally perpendicular to the longitudinal axis of, to the direction of travel of, and to the sides of the strip of paper 87 and is spaced apart from adjacent lines of weakening. Strip 87, which was previously folded along the lines of weakening and was then unfolded for processing, is directed into the apparatus of FIG. 1 to be refolded. In FIG. 1, strip 87 is folded along the lines of weakening 89 to form folds 88. When chute 10 is in the position illustrated in FIG. 1, a line of weakening preferably is positioned a distance, indicated by arrows C, from the back lip or edge 100 of the mouth 13 of chute 10. This distance C is about one quarter to three eighths of an inch. The lower lip 100 of the back panel 12 of chute 10 extends a distance, indicated by arrows D, beyond the lower lip or edge 101 of the front panel 11 of chute 10. Distance D is presently about one inch and the length, indicated by arrows E, of panel 12 is about ten inches. The extension of lip 100 beyond lip 101 is important and improves the efficient operation of the apparatus of the invention. If lip 101 extended down to lip 100, then when chute 10 moved from its position in FIG. 1 in the direction of arrow B, chute 10 would tend to pull the line of weakening just distributed by the chute away from axle 20 in the direction of arrow B. After chute 10 has moved in the direction of arrow B to the furthest extent of its travel, and begins to move in the direction of arrow A, lip 101 "snaps" the paper and promotes the folding of the line of weakening just distributed by chute 10. Each paddle wheel 15, 16 is of equal shape and dimension and includes a plurality of equally spaced outwardly extending paddles or arms 17 attached to the cylindrical periphery 18 of the paddle wheel. Each arm 17 extends outwardly a distance, indicated by arrows F, from periphery 18. Distance F is presently approximately one quarter of an inch. The space between a pair of opposing, adjacent paddles 17 is presently about one half of an inch. The diameter of each cylindrical peripheral surface 18 is about two and one-eighth inches. Paddle wheels 15 are attached to and rotate simultaneously with driven axle 20. Paddle wheels 16 are fixedly attached to and rotate simultaneously with driven axle 21. Axles 20 and 21 presently have a diameter of approximately five-eighths of an inch. The longitudinal centerline of axle 21 is about three and a half inches above the belts 23 which move in the direction of arrow G over conveyor table 22. The longitudinal centerline of axle 20 is about four and one-quarter inches above belts 23. The shortest horizontal distance indicated by arrows H, between the longitudinal centerline of axles 20 and 21 is about one and three-fourths inches. Axles 20 and 21 and paddle wheels 15 and 16 rotate in the directions indicated by arrows I and J. On paddle wheels 15, the outer tips of each paddle 17 lie on an imaginary circle which is outside and concentric with peripheral surface 18. The closest distance of approach of lip 100 to this concentric imaginary circle is about one-eighth of an inch. Each time chute 10 moves in the direction of arrow A, it moves to a "home" position within about one-eighth of an inch of this concentric circle. Chute 10 continues to move to and from this home position even when the fold length changes. When chute 10 is in the position illustrated in FIG. 1, lip 100 is positioned below the longitudinal centerline of axle 20. This positioning of lip 100 below the longitudinal centerline of axle 20 is important because it insures that paper is delivered to and contacted by paddle wheels 15 at a point below the longitudinal centerline of axle 20 and wheels 15. When chute 10 is in the position illustrated in FIG. 1 lip 101 is preferably positioned above the longitudinal centerline of axle 20.

In FIG. 1, the distance of the longitudinal centerline of axle 21 above belts 23 is indicated by arrows K and is, an noted, about three and a half inches. The vertical distance, indicated by arrows L, between the longitudinal centerlines of axles 20 and 21 is about three-quarters of an inch.

Paddle wheels 15 and 16 are presently preferably fabricated from a substantially rigid plastic. Brushes can be substituted for paddles or arms 17, as can a variety of resilient or rigid materials. Substantially rigid arms 17, however, presently appear to give the best results.

Shafts 32 and 33 are fixedly attached to chute 10 and are journalled for rotation in a frame (not shown). The ends of axles 20 and 21 are also journalled for rotation in the same frame, and table 22 typically is carried on the frame. Motive power means for oscillating chute 10, for rotating axles 20 and 21, and for moving belts 23 are well known in the art and will not be discussed in detail herein. One chute oscillation system is more specifically described below with respect to FIG. 3.

Axle 20 presently rotates at a speed which is greater than the speed at which axle 21 rotates. The outer ends of tips of the arms 17 on paddle wheels 15 contact and impart downward and forward forces to paper strip 87 dispensed by chute 10. Paddle wheels 16 on axle 21 "catch" the folds or crests 88 in the paper. The rotation of axle 21 and paddle wheels 16 is slightly retarded with respect to the speed of movement of belts 23 in the direction of arrow G, and arms 17 slightly temporarily impede the progress of each fold 88, facilitating the creation of spaces spacing between folds 88. The distance, indicated by arrows M, between adjacent pairs 88 of folds moving along table 22 is in the range of one-quarter of an inch to three inches, preferably about one inch. A distance of about one inch facilitates the stacking of the refolded paper on a horizontal stacking platform or table of the type earlier described herein. As each fold 88 passes by the paddle wheels 16, fold 88 preferably contacts the outer surface 18 of each paddle wheel. The contact and frictional engagement between surface 18 and fold 88 facilitates the control and gradual movement of the fold by paddle wheels 16. If surface 18 is serrated, sufficiently roughened, provided with an adhesive substance, or otherwise adapted to increase its frictional contact of a fold 88, surface 18 engages and moves fold 88 without requiring the use of arms 17. When the outer surface 18 of the paddle wheel 16 contacts a fold or crest 88, surface 18 slightly compresses or downwardly forces fold 88 toward table 22 such that when a fold 88 moves by and free from wheels 16, it springs upwardly a short distance and is positioned a greater distance above belts 23 than when the fold was beneath paddle wheels 16 and contacting surfaces 18.

At least one paddle wheel 15 is mounted on axle 20. At least one wheel 16 is mounted on axle 21.

When a strip of paper 87 moves through the folding apparatus of FIG. 1 at a selected speed and the paper is being folded into a desired fold length, for example a fold length of fourteen inches, the chute 10, conveyor belts 23 and axles 20 and 21 generally move at selected generally uniform speeds. The conveyor belts 23 move at a rate which carries fold 88 in the direction of arrow G at a slightly faster rate than would be permitted by wheels 16. This faster movement of folds 88 by belts 23 facilitates the production of spaces, indicated by arrows M, between folds or crests 88. The speed of belts 23 is adjusted such that during operation of the apparatus of FIGS. 1 and 2, successive folds 88 are usually each received between a successive adjacent pair of arms 17 on wheels 16. Sometimes a pair of adjacent arms 17 will be skipped and will not receive a fold 88. This situation is illustrated in FIG. 1, where a fold was not received between arms 17A and 17B.

In FIG. 1, the distance, indicated by arrows 0, of shaft 32 above belts 23 is about 12 inches and the distance, indicated by arrows N, between axle 20 and shaft 32 is approximately nine inches. The shape and dimension and spacing relationship between the components of the apparatus of FIGS. 1 and 2 can be altered as desired to accomplish the functions of the apparatus described herein.

Figure 3:
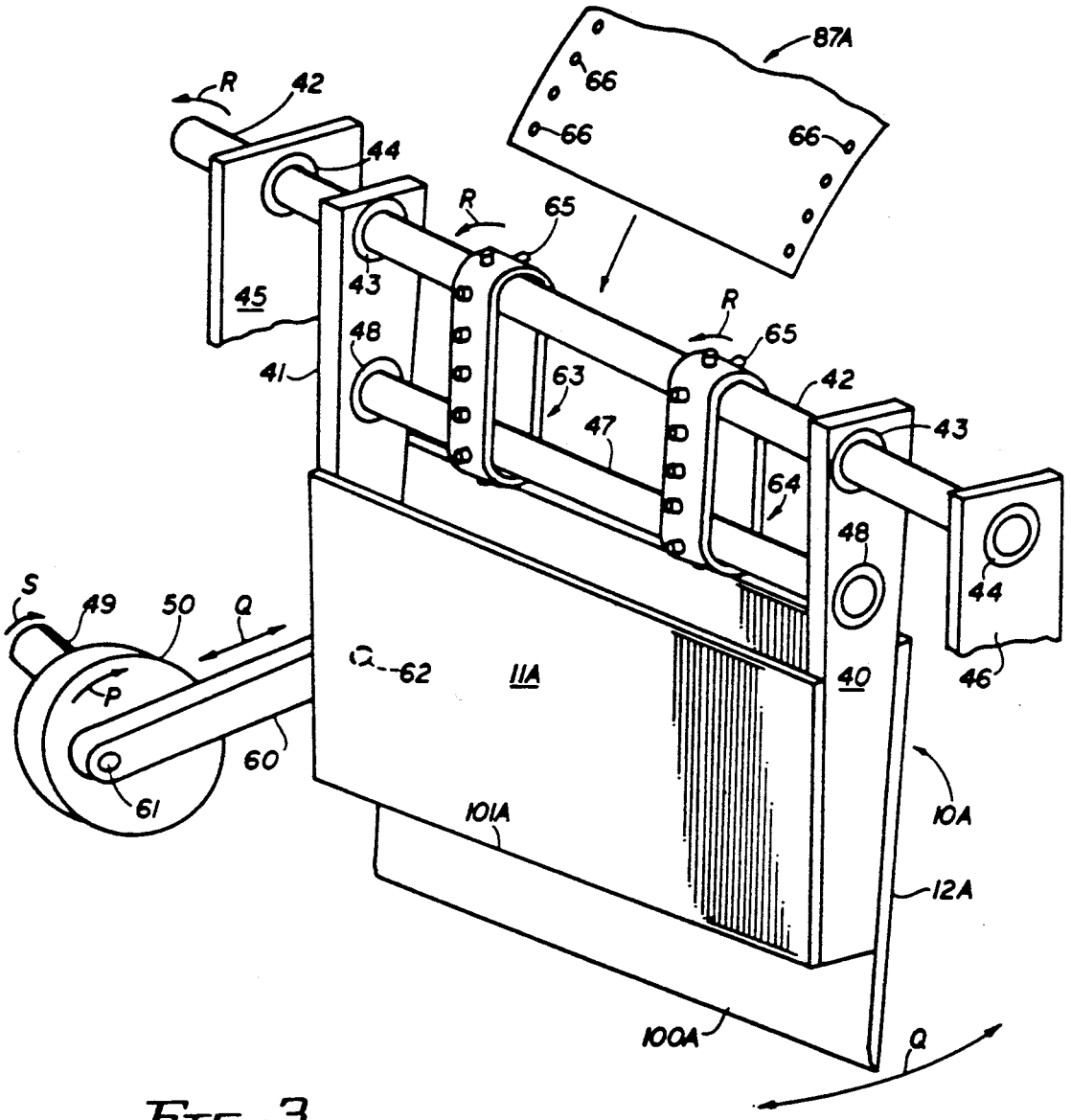
FIG. 3 is a perspective view illustrating mechanisms for driving the chute and directing a paper strip into a chute in accordance with the invention.

The apparatus of FIGS. 1 and 2 is utilized to fold paper which was earlier folded and then unfolded for printing or other processing. Since the paper being directed into chute 10 has been previously folded, it is less rigid than unfolded paper and tends to kink or bend along the lines of weakening and to jam the paper folding machine. Maintaining careful control the paper strip 87 as it moves through the apparatus is therefore important. One mechanism for maintaining control of the paper is illustrated in FIG. 3 in which chute 10A includes front panel 11A and rear panel 12A. Panel 12A includes lower lip 100A. Panel 11A includes lower lip 101A. Panels 11A and 12A are fixedly attached to side panels 40 and 41. Shaft 42 is rotatably received by bushings 43 and 44. The bushings 43 are journalled in fixed frame members 45 and 46. Bushings 43 are journalled in panels 40 and 41. Free wheeling shaft 47 is rotatably received by bushings 48 journalled in panels 40 and 41. Shaft 49 is journalled in a fixed frame member (not shown) and is attached to cylindrical cam 50 which rotates in the direction of arrow P. Link 60 is pivotally attached 61 to cam 50 and is pivotally attached 62 to panel 41. When cam 50 rotates in the direction of arrow P, link 60 and chute 10A oscillate in the directions indicated by arrow Q. When shaft 42 rotates in the direction of arrow R, shaft 42 turns endless belts 63 and 64 about shaft 42 and free wheeling shaft 47. Belts 63 and 64 include outwardly projecting teeth or nipples 65 which engage a paper strip 87A by extending through cylindrical apertures 66 formed along the edges of strip 87A. Teeth 65 release their associated apertures 66 just prior to strip 87A traveling into chute 10A.

The motive power means for turning shaft 42 in the direction of arrow R and turning shaft 49 in the direction of arrow S are well known in the art and are not described herein.

Figure 4:
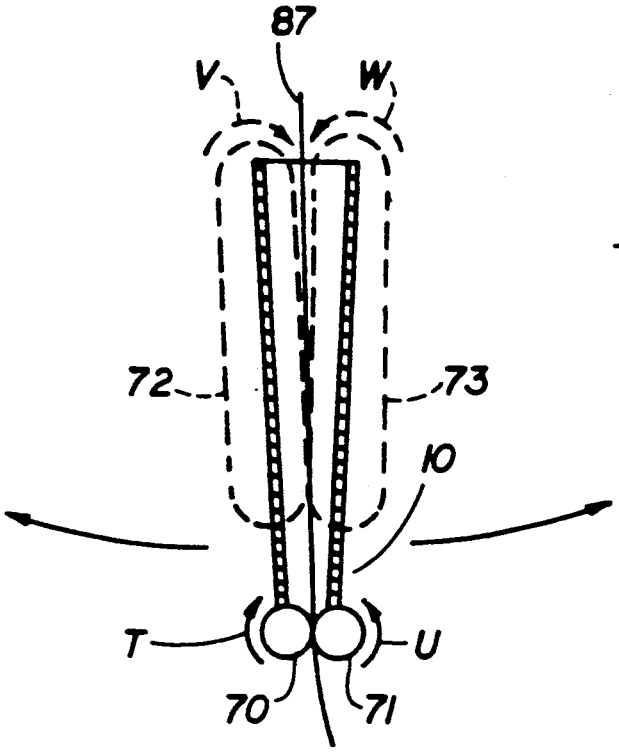
FIG. 4 is a side view illustrating alternate methods of controlling movement of a paper strip through a chute; and, FIG. 5 is a side view illustrating an alternate embodiment of a paddle wheel utilized in the invention.

Other means for increasing the control over a paper strip 87 as it moves through a chute 10 are illustrated in FIG. 4. A pair of rollers 70 and 71 can be mounted at the mouth of chute 10 to draw and tension a paper strip 87 moving through chute 10. Rollers 70 and 71 would rotate in the directions indicated by arrows T and U. Alternately, a pair of opposed belts 72 and 73 can be mounted on the chute 10 and move in the directions indicated by arrows V and W to guide a paper strip 87 through the chute.

Figure 5:
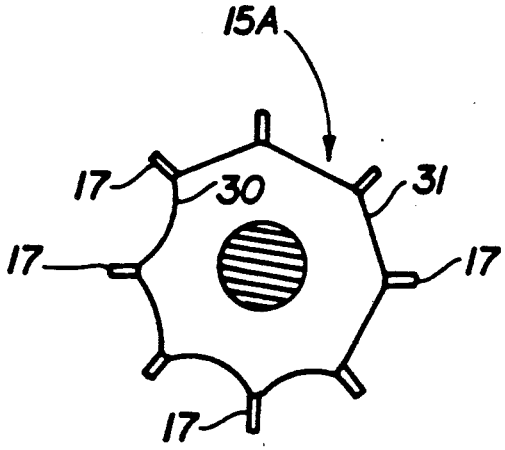

FIG. 5 illustrates an alternate embodiment of the wheels 15 or 16. In the wheel 15A concave 30 and flat planar 31 surfaces are provided in place of the convex cylindrical surface 18 found on each wheel 15, 16.

Wheels 15 are fixedly attached to shaft 20 in the same orientation and with the arms 17 on a wheel 15 each in alignment with arms 17 on the remaining wheels 15. Each arm 17 on one wheel 15 lies in a radial plane with one arm 17 from each of the other wheels 15. The plane passes through wheels 15 and the longitudinal axis of axle 20. For example, in FIG. 2 one arm 17 from each of the wheels 15 lies along dashed line 80. Line 80 lies in a plane which passes through the longitudinal axis of axle 20.

Similarly, wheels 16 are fixedly attached to shaft 21 in the same orientation and with the arms 17 on one wheel 16 each in alignment with an arm 17 on the remaining wheel 16. Each arm 17 on one wheel 16 lies in a radial plane with another arm 17 from the other wheel 16. The plane passes radially through wheels 16 and the longitudinal axis of axle 21.

Since the arms 17 on wheels 15 perform the function of downwardly displacing or beating paper strip 87, mounting each wheel 15 on shaft 20 in the identical orientation described above is not critical, especially because wheels 15 and axle 20 normally rotate at a fairly rapid rate. On the other hand, mounting wheels 16 on axle 21 in the same orientation is more important. As is evident from the side view of FIG. 1, the arms 17 on one wheel 16 are in alignment with the arms 17 on the other wheel 16. If in FIG. 1 the position of one wheel 16 was slightly rotated on shaft 21 so that the arms 17 on that one rotated wheel were not in alignment with the arms 17 on the remaining wheel and were instead offset with respect to the arms 17 on the remaining wheel 16, this offset relationship of the arms 17 on one wheel with respect to the arms on the other wheel 16 could interfere with the reception of fold 88 between opposing adjacent pairs of arms 17 on the wheels 16. Therefore, when there are two or more wheels 16, it is presently preferred that each wheel 16 be mounted on axle 21 in the same orientation.

If desired, axle 21 can be sized such that surface 18 is coextensive with and has the same diameter and shape and dimension as the outer surface of axle 21, or, arms 17 can be attached directly to axle 21.

Having described my invention in such terms as to enable those skilled in the art to understand and practise it, and having identified the presently preferred embodiments thereof, I claim:

1. In combination with apparatus for producing continuous form stationery by refolding a strip of paper along transverse lines of weakening formed therein, said apparatus including a frame, oscillating guide means mounted on said frame for alternately distributing said successive lines of weakening in said paper in substantially opposite directions, and means for feeding paper into said guide means at a predetermined speed, the improvement comprising folding means carried on said frame and operatively associated with said oscillating guide means to receive said lines of weakening distributed by said oscillating guide means in one of said opposite directions to urge said paper distributed by said guide means into a folded condition, said folding means including (a) first driven axle means rotatably mounted on said frame near said lines of weakening distributed by said guide means in said one of said opposite direction, said axle means having a longitudinal axis of rotation generally parallel to said distributed lines of weakening;

(b) a plurality of spaced apart outwardly extending beater arms carried on said driven axle means, simultaneously rotating with said driven axle, and shaped and dimensioned to contact and downwardly displace paper distributed by said oscillating guide means;

(c) second driven axle means
(i) rotatably mounted on said frame,
(ii) spaced apart from said first driven axle means, and
(iii) having a longitudinal axis of rotation generally parallel to said distributed lines of weakening and said longitudinal axis of said first driven axle means; and, (d) a plurality of spaced apart outwardly extending receiving arms
(i) carried on said second driven axle means,
(ii) simultaneously rotating with said second driven axle means,
(iii) receiving folded lines of weakening between opposing pairs of said receiving arms, and
(iv) guiding said lines of weakening received between said receiving arms away from said oscillating guide means and from said first driven axle means.

2. The combination of claim 1 wherein said first driven axle means rotates at a speed greater than said second driven axle means.

3. In combination with apparatus for producing continuous form stationery by refolding a strip of paper along transverse lines of weakening formed therein, said apparatus including frame means, oscillating guide means mounted on said frame means for alternately distributing said successive lines of weakening in said paper in substantially opposite directions, and means for feeding paper into said guide means at a predetermined speed, the improvement comprising folding means carried on said frame means and operatively associated with said oscillating guide means to receive said lines of weakening distributed by said oscillating guide means in one of said opposite directions to urge said paper distributed by said guide means into a folded condition, said folding means including (a) displacement means to contact and downwardly displace paper distributed by said oscillating guide means;

(b) driven axle means
(i) rotatably mounted on said frame means,
(ii) spaced apart from said displacement means, and
(iii) having a longitudinal axis of rotation generally parallel to said distributed lines of weakening; and, (c) a contact surface
(i) carried on said driven axle means,
(ii) simultaneously rotating with said driven axle mans about said longitudinal axis of rotation, and
(iii) engaging folded lines of weakening to generate forces on said folded lines of weakening acting in a direction away from said oscillating guide means.

4. In combination with apparatus for producing continuous form stationery by refolding a strip of paper along transverse lines of weakening formed therein, said apparatus including a frame, oscillating guide means mounted on said frame for alternately distributing said successive lines of weakening in said paper in substantially opposite directions, and means for feeding paper into said guide means at a predetermined speed, the improvement comprising folding means carried on said frame and operatively associated with said oscillating guide means to receive said lines of weakening distributed by said oscillating guide means in one of said opposite directions to urge said paper distributed by said guide means into a folded condition, said folding means including (a) displacement means to contact and downwardly displace paper distributed by said oscillating guide means;

(b) driven axle means
(i) rotatably mounted on said frame,
(ii) spaced apart from said displacement means, and
(iii) having a longitudinal axis of rotation generally parallel to said distributed lines of weakening;

(c) a plurality of spaced apart outwardly extending receiving arms
(i) carried on said driven axle means,
(ii) simultaneously rotating with said driven axle means about said longitudinal axis of rotation,
(iii) receiving folded lines of weakening between opposing pairs of said receiving arms, and
(iv) guiding said lines of weakening received between said receiving arms away from said oscillating guide means; and, (d) conveyor means for receiving paper distributed by said oscillating guide means and moving said distributed paper beneath said driven axle means.

5. The combination of claim 4 wherein said conveyor means moves said distributed paper at a speed of travel such that said arms simultaneously contact said paper adjacent at least selected ones of said folded lines of weakening and temporarily retard the movement of said selected ones of said lines of weakening with respect to the movement of said conveyor means.

* * * * *